US010159982B2

(12) United States Patent
Yeo et al.

(10) Patent No.: US 10,159,982 B2
(45) Date of Patent: Dec. 25, 2018

(54) CONTROL SYSTEMS AND METHODS FOR BIOLOGICAL APPLICATIONS

(75) Inventors: Huei Yeo, Singapore (SG); Soo Yong Lau, Singapore (SG); Cong Jiang, Singapore (SG)

(73) Assignee: Applied Biosystems B.V., Helios (SG)

( * ) Notice: Subject to any disclaimer, the term of this patent is extended or adjusted under 35 U.S.C. 154(b) by 718 days.

(21) Appl. No.: 13/315,221

(22) Filed: Dec. 8, 2011

(65) Prior Publication Data

US 2012/0145587 A1 Jun. 14, 2012

Related U.S. Application Data

(60) Provisional application No. 61/421,204, filed on Dec. 8, 2010.

(51) Int. Cl.
*B01L 7/00* (2006.01)

(52) U.S. Cl.
CPC ..... *B01L 7/52* (2013.01); *B01L 2200/0689* (2013.01); *B01L 2200/142* (2013.01); *B01L 2300/0829* (2013.01); *B01L 2300/1827* (2013.01)

(58) Field of Classification Search
CPC ..... B01L 7/54; B01L 7/52; B01L 3/50851
See application file for complete search history.

(56) References Cited

U.S. PATENT DOCUMENTS 5,282,543 A * 2/1994 Picozza et al. ..... 220/255
5,475,610 A 12/1995 Atwood et al.
6,015,534 A * 1/2000 Atwood ..... 422/550
7,133,726 B1 11/2006 Atwood et al.
7,459,302 B2 12/2008 Reid et al.
2002/0072112 A1 6/2002 Atwood et al.
2004/0033592 A1 * 2/2004 Shin et al. ..... 435/287.2
2007/0117200 A1 5/2007 Atwood et al.
(Continued)

FOREIGN PATENT DOCUMENTS

CN 1092109 A 9/1994
DE 102009015869 10/2010
(Continued)

OTHER PUBLICATIONS

International Search Report and Written Opinion for International Application No. PCT/US2011/064036 dated Aug. 23, 2012.
(Continued)

*Primary Examiner* — Jonathan M Hurst

(57) ABSTRACT

A thermal cycler is provided. The thermal cycler comprises a tray assembly. The tray assembly comprises a main body made of a first material having a first thermal conductivity. The tray assembly further comprises an adaptor made of a second material having a thermal conductivity that is greater than the thermal conductivity of the first material. The thermal cycler also includes a control block configured to control the temperature of the one or more nucleotide samples. The thermal cycler further includes a thermal cover sized and positioned to at least partially cover the plurality of vessels. The thermal cycler further includes a sample block including one or more depressions configured to receive a plurality of vessels containing one or more nucleotide samples.

12 Claims, 6 Drawing Sheets

(56) References Cited

U.S. PATENT DOCUMENTS

| | | | | |
|---|---|---|---|---|
| 2009/0275116 | A1* | 11/2009 | Subramanyam .... | B01L 3/50851<br>435/287.2 |
| 2010/0152066 | A1 | 6/2010 | Malik et al. | |
| 2010/0303689 | A1 | 12/2010 | Peterson et al. | |

FOREIGN PATENT DOCUMENTS

| | | | |
|---|---|---|---|
| WO | 2001/07160 | | 2/2001 |
| WO | 2001/56697 | A1 | 8/2001 |
| WO | 2004/108288 | | 12/2004 |
| WO | 2009/094495 | | 7/2009 |
| WO | 2009/100933 | | 8/2009 |

OTHER PUBLICATIONS

Annex to Form PCT/ISA/206, Communication Relating to the Results of the Partial International Search for Int'l Application No. PCT/US2011/064036 dated Apr. 26, 2012.

* cited by examiner

CONTROL SYSTEMS AND METHODS FOR BIOLOGICAL APPLICATIONS

FIELD

The field of the present teaching is for a tray assembly for use with an array of sample vessels in a thermal cycling system.

BACKGROUND

The analysis of thermal non-uniformity (TNU) is an established attribute of the art for characterizing the performance of a thermal block assembly, which may be used in various bio-analysis instrumentation. TNU is typically measured in a sample block portion of a thermal block assembly, which sample block may engage a sample support device. TNU may be expressed as either the difference or the average difference between the hottest and the coolest locations in the sample block. For example, TNU may be determined as a difference or average difference between a hottest and a coldest sample temperature or position in a sample block. An industry standard, set in comparison with gel data, may express TNU so defined as a difference of about 1.0° C., or an average difference of 0.5° C. Historically, the focus on reducing TNU has been directed towards the sample block. For example, it has been observed that the edges of the sample block are typically cooler than the center, and this difference in temperature is transferred to a biological sample being processed in the sample support device.

One of the common reasons for non-uniformity across a plurality of samples, particularly when placed in an array of wells, is referred to in the art as edge effects. Edge effects typically occur in configurations where the wells at the outer edges of a microtiter plate, for example, release heat to the ambient more rapidly than the wells located in the center of the microtiter plate. This results in a temperature differential between the center wells and the outer wells. This effect is exacerbated by water in the biological sample evaporating inside the well and condensing on the inner wall of the well above the biological sample. One skilled in the art would realize that a loss of fluid in the biological sample alters the concentration of the reactants in the biological sample and also affects the pH of the reaction. Both the change in concentration and pH affect the efficiency of the reaction resulting in non-uniform reaction efficiencies across the wells of the microtiter plate and therefore, the biological samples.

Various embodiments of a sample block may be adapted to receive various sample containing devices, such as a microtiter plate. Additionally, various embodiments of a sample block may have a substantially flat surface adapted to receive a substantially planar sample-containing device, such as a microcard. In a sample block capable of receiving a microtiter plate or microcard or any other vessel suitable for nucleotide processing, biological samples deposited in the vessels may undergo thermal cycling according to a thermal cycling profile. For example, a two setpoint thermal cycling profile may include a setpoint temperature for a denaturation step and a setpoint temperature for an annealing/extension step. Setpoint temperatures for a denaturation step may be between about 94-98° C., while setpoint temperatures for an annealing/extension step may be between about 50-65° C. Alternatively, three setpoint temperature protocols can be used, in which the annealing and extension steps are separate steps. According to various protocols, the setpoint temperature for an extension step may be between about 75-80° C. During the defined steps of a thermal cycle, in order to allow time for the chemical process at that step, a specified hold time for the setpoint temperature may be defined. One of ordinary skill in the art is apprised the hold times for various steps in a thermal cycle may be for different intervals. For all protocols, regardless of the setpoint temperature protocol used, one of ordinary skill in the art would understand that the success or failure of the protocol depends, at least in part, on a thermal cycler achieving the desired temperature of each setpoint, and each well containing a biological sample being subjected to that setpoint temperature throughout the hold time as mentioned above.

It is important for one of ordinary skill in the art to be able to determine the thermal non-uniformity of a sample block assembly. A common approach is to use, for example, thermocouples, thermistors, PRTs or other types of thermal sensors well known in the art. The sensors are used to detect temperatures at various points across an array of sample vessels. The measured temperatures are then used to calculate temperature non-uniformity and compare the result to the accepted values as discussed above.

In the present teachings, the effects of condensation and evaporation of aqueous components of the biological samples, were discovered to be a significant factor contributing to temperature non-uniformity of thermal block assemblies currently available and in use within the bio-analysis research community. The present teachings present an innovative approach to controlling the condensation and evaporation of the aqueous components in biological samples, which embodiments according to the present teachings are in contrast to various established teachings of the art.

SUMMARY OF THE INVENTION

In an embodiment of the present invention, a tray assembly for controlling ambient temperature uniformity across a plurality of vessels is presented. The tray assembly comprises a main body made of a first material having a first thermal conductivity. The main body also has a plurality of openings configured to receive a plurality of vessels containing one or more nucleotide samples. The tray assembly further includes an adaptor made of a second material having a second thermal conductivity. Further, the thermal conductivity of the adaptor is greater than the thermal conductivity of the main body.

In another embodiment, the main body of the tray assembly is adapted to receive at least one seal.

In another embodiment, the at least one seal is selected from a group consisting of a top seal disposed between the main body and a thermal cover, one or more bottom seals disposed between the main body and a sample block, and a combination thereof.

In another embodiment, the first material has a thermal conductivity less than 2 W/(m·K) and the second material has a thermal conductivity greater than 200 W/(m·K).

In another embodiment, the first material comprises a polymer material and the second material comprises a metal.

In another embodiment, the first material comprises polycarbonate and the second material comprises a metal selected from the group consisting of aluminum, copper, and steel.

In another embodiment, the second material comprises copper.

In another embodiment, the second material comprises a stainless steel alloy.

In another embodiment, the adaptor comprises a plurality of openings corresponding to the plurality of openings of the main body.

In another embodiment, the adaptor comprises a plurality of thermally conductive elements.

In an embodiment of the present invention, a thermal cycler is provided. The thermal cycler comprises a tray assembly. The tray assembly comprises a main body made of a first material having a first thermal conductivity. The tray assembly further comprises an adaptor made of a second material having a thermal conductivity that is greater than the thermal conductivity of the first material. The thermal cycler also includes a control block configured to control the temperature of the one or more nucleotide samples. The thermal cycler further includes a thermal cover sized and positioned to at least partially cover the plurality of vessels. The thermal cycler further includes a sample block including one or more depressions configured to receive a plurality of vessels containing one or more nucleotide samples.

In another embodiment, the main body is adapted to receive at least one seal.

In another embodiment, the adaptor is disposed between the main body and the one or more nucleotide samples.

In another embodiment, the thermal cover and tray assembly are configured to produce a plurality of temperature zones, when the plurality of vessels are located within the sample block during operation of the thermal cycler.

In another embodiment, the plurality of temperature zones within the vessels vary from one another within a predetermined temperature range.

In another embodiment, wherein the plurality of temperatures vary from one another by an amount that is less than or equal to 0.6 degrees Celsius.

In another embodiment, the plurality of temperatures vary from one another by an amount that is less than or equal to 0.5 degrees Celsius.

In another embodiment, the plurality of temperatures vary from one another by an amount that is less than or equal to 0.3 degrees Celsius.

In an embodiment of the present invention a method for nucleotide processing is provided. The process includes providing a sample block configured to receive a plurality of vessels containing one or more nucleotide samples. The process also includes providing a thermal cover configured to at least partially cover the plurality of vessels. The process further includes controlling the temperature of the one or more nucleotide samples by disposing a main body and adaptor between the thermal cover and the sample block. The main body and adaptor reduces evaporation and/or condensation across the plurality of vessels during nucleotide processing.

In another embodiment, the controlling step further includes distributing ambient heat across the plurality of vessels during nucleotide processing.

Additional aspects, features and advantages of the present invention are set forth in the following description and claims, particularly when considered in conjunction with the accompanying drawings in which like parts bear like reference numbers.

BRIEF DESCRIPTION OF THE DRAWINGS

Embodiments of the present invention may be better understood from the following detailed description when read in conjunction with the accompanying drawings. Such embodiments, which are for illustrative purposes only, depict novel and non-obvious aspects of the invention. The drawings include the following figures.

DETAILED DESCRIPTION

The present teachings disclose various embodiments of a tray assembly having low thermal non-uniformity throughout the assembly. As will be discussed in more detail subsequently, various embodiments of thermal assemblies having such low thermal non-uniformity provide for desired performance of bio-analysis instrumentation utilizing such thermal assemblies.

Figure 1:
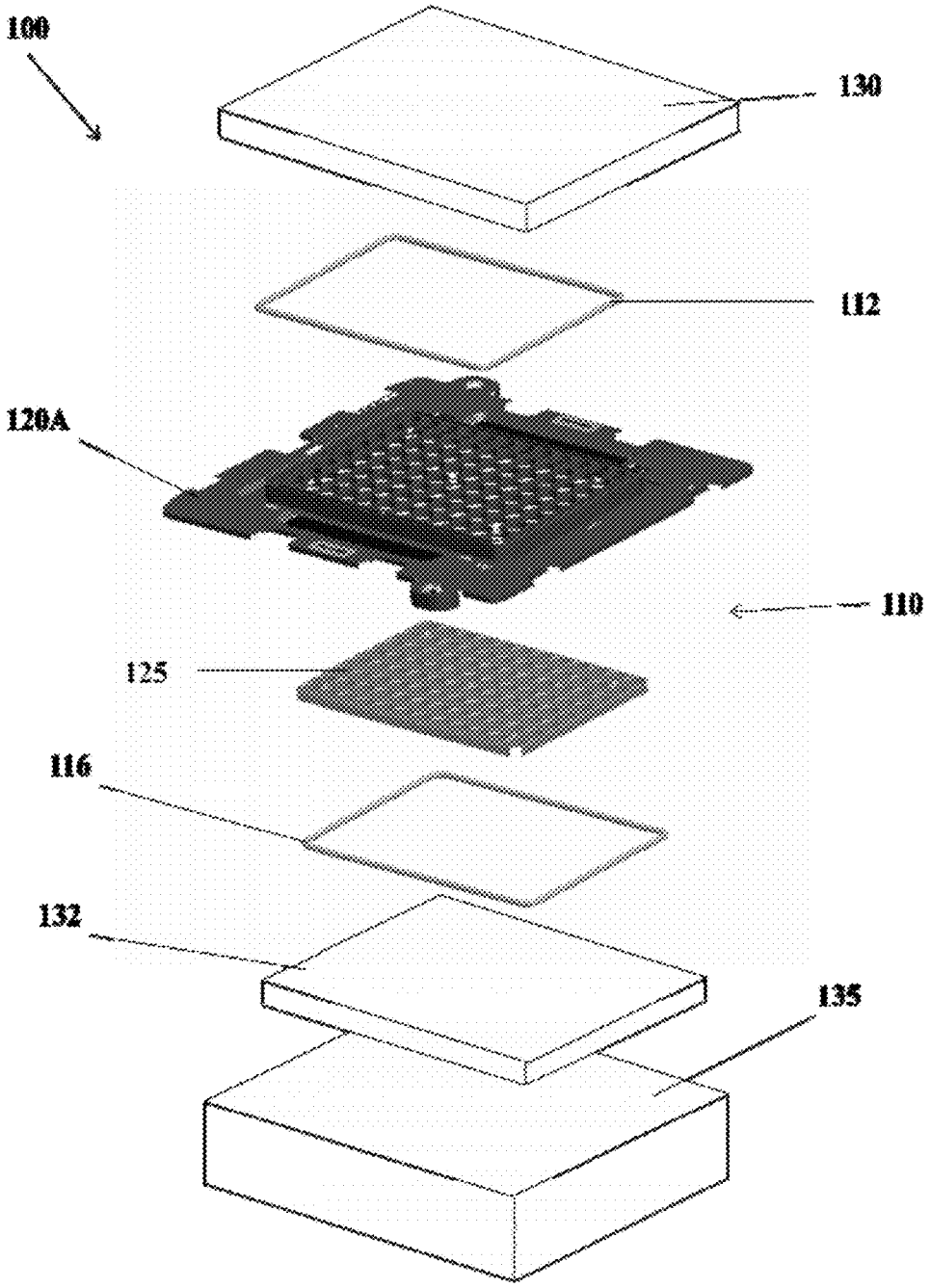
FIG. 1 is a perspective view of a thermal cycler assembly according to various embodiments of the present teachings.

For understanding the aspects of the present teachings a review of the drawings is beneficial. As illustrated in FIG. 1, for example, a thermal cycler system 100 can include a thermal cover 130, a sample block 132, a control block 135 and a tray assembly 110, which can be disposed between thermal cover 130 and sample block 132. Tray assembly 110 can further include a main body including a main body first surface 120A, a main body second surface 120B (see FIG. 3), a first seal 112, a second seal 116, a third seal 115 (see FIG. 3) and an adaptor 125. Tray assembly 110 will be discussed in more detail below.

In some embodiments, thermal cover 130 may be configured to at least partially cover a plurality of vessels containing biological samples disposed in a plurality of wells provided in sample block 132. In another embodiment, thermal cover 130 may have a portion (not illustrated) that protrudes such that it can be disposed above and along a peripheral portion of the plurality of vessels received in sample block 132. Taken in combination, thermal cover 130, tray assembly 110 and sample block 132 can provide a chamber containing the vessels with biological samples. The chamber can provide improved isolation of the vessels from ambient conditions, as compared to thermal cyclers not incorporating tray assembly 110 as described. Thermal cover 130 may also contain a controlled independent heat source (not illustrated) to assist in maintaining a defined temperature in the chamber.

In some embodiments, control block 135 may be made up of one or more thermoelectric devices (TECs), a heat exchanger, a heat sink, a cold sink or any combination thereof, all of which are available from various suppliers and are well known in the art. Control block 135 may also be configured to control the temperature of the sample block, as well as the plurality of vessels or biological samples contained therein. In other embodiments, control block 135 and sample block 132 may be combined to form a single piece. Combining to form a single piece may be achieved through the use of, for example, an adhesive, an epoxy or fasteners. The fasteners may include, for example, screws, bolts and clamps.

Figure 2:
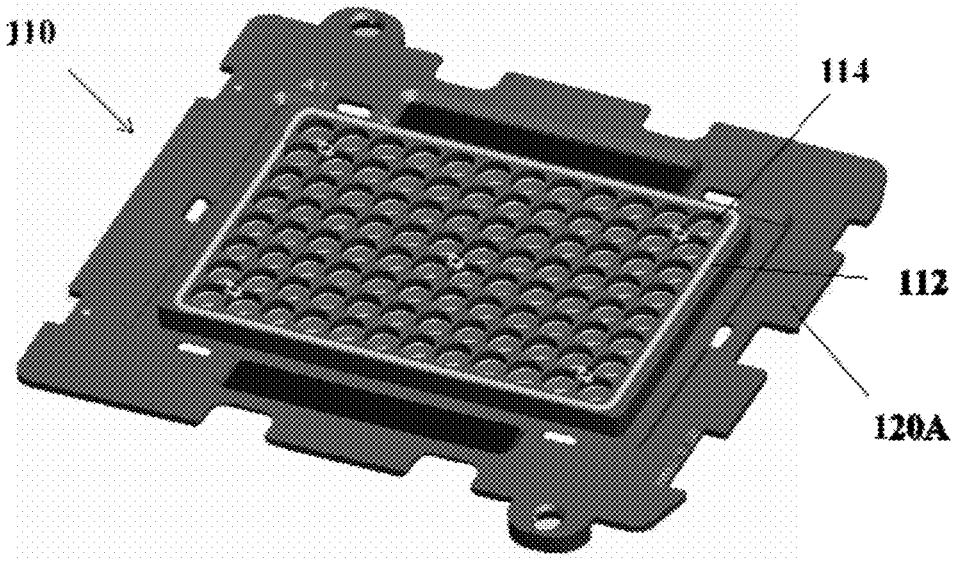
FIG. 2 is a first view of a tray assembly according to various embodiments of the present teachings.

FIG. 2 depicts tray assembly 110, the main body, and in particular main body first surface 120A. The main body may be constructed of a polymer type material such as, for example, polycarbonate, PC-ABS, Ultem 1000 or Ultem 2000. In certain embodiments, the material of the main body can have a thermal conductivity less than 2 W/(m*K). The main body may also contain one or more apertures 114 suitable for receiving one or more vessels, wherein such vessels may be suitable for receiving, for example, a biological sample for nucleotide processing. Apertures 114 may be configured in an array, such that the vessels might constitute a microtiter plate. Microtiter plates of various formats are well known in the art and available from numerous sources in numerous aperture formats such as, for example, 24, 96, 384 and 1536 wells.

FIG. 2 further illustrates that, in some embodiments, main body first surface 120A can be adapted to receive first seal 112. The adaptation may be a trough, slot, depression or any geometry suitable for receiving first seal 112. The adaptation may be formed by machining, molding or other process suitable for the material of main body 120. First seal 112 may be constructed of a polymer such as, for example, silicone rubber, elastomer or poron. First seal 112 may be any suitable shape including, but not limited to, cylindrical, rectangular or ellipsoid shape, the seal being shaped as necessary to be received within the provided adaptation in main body first surface 120A. First seal 112 may be, for example, an off the shelf component, or custom molded or extruded. First seal 112 may also be secured to the main body by any number of means such as, for example, adhesive tape, press fitting, heat or ambient cured epoxy or adhesive, RTV, ultrasonic welding or other techniques known to one of ordinary skill in the art.

Figure 3:
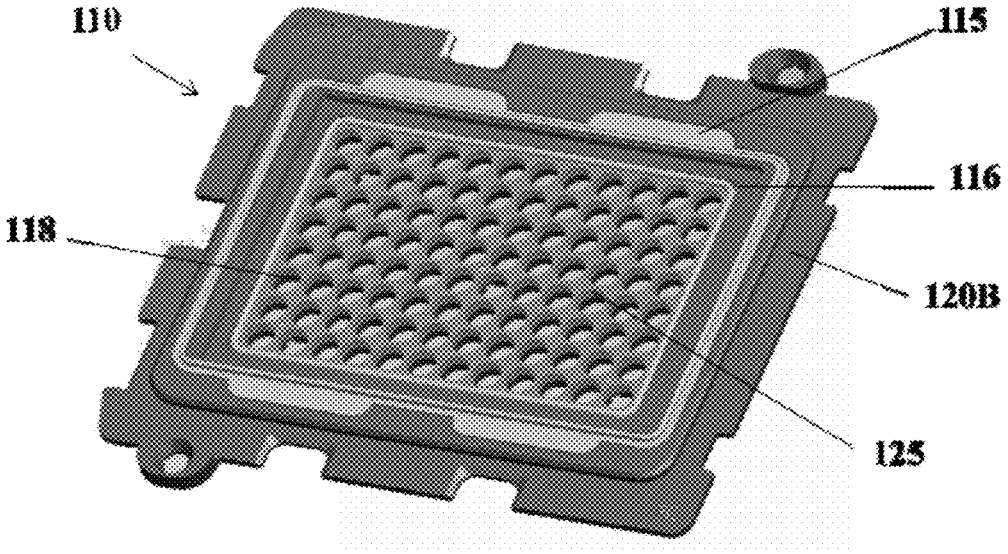
FIG. 3 is a second view of a tray assembly according to various embodiments of the present teachings.

Turning now to FIG. 3, tray assembly 110 and main body second surface 120B are depicted with an example of adaptor 125. In some embodiments, adaptor 125 may be located on main body first surface 120A. In other embodiments adaptor 125 may be located on main body second surface 120B. Adaptor 125 may be constructed of a material with different characteristics from the main body. For example, the material of adaptor 125 can have a thermal conductivity greater than 200 W/(m*K). The material of adaptor 125 can be a metal such as, for example, aluminum, copper, steel or a stainless steel alloy. Such characteristics of adaptor 125 contribute to a temperature uniformity of adaptor 125. The temperature uniformity of adaptor 125 may also influence the temperature uniformity of the chamber described above. In some embodiments, the temperature uniformity of adaptor 125 may be less than or equal to 0.6° C. In another embodiment the temperature uniformity of adaptor 125 may be less than or equal to 0.5° C. In yet another embodiment the temperature uniformity of adaptor 125 may be less than or equal to 0.3° C.

Adaptor 125, as shown in FIG. 3 may have one or more apertures 118 similar to apertures 114 in the main body as previously discussed above in FIG. 2. Apertures 118 of adaptor 125 may be aligned with apertures 114 of the main body. Aligning apertures 114 to apertures 118 can make tray assembly 110 suitable for receiving one or more vessels, where such vessels may be suitable for receiving a biological sample for nucleotide processing.

Adaptor 125 in FIG. 3 may be secured to the main body. Adaptor 125 may be, for example, secured to or embedded in the main body first surface 120A or main body second surface 120B. In other embodiments, adaptor 125 may be secured to the main body with, for example, one or more fasteners, an adhesive, or epoxy (not shown). In still other embodiments, adaptor 125 may be ultrasonically welded to the main body.

FIG. 3 also depicts main body second surface 120B having one or more adaptations for receiving second seal 116 and/or third seal 115 located around the periphery of adaptor 125. As discussed above with reference to first seal 112 illustrated in FIG. 2, the adaptation may be, for example, a trough, slot, depression or any geometry suitable for receiving the desired seal. The adaptation may be formed by machining, molding or other process suitable for the material of the main body. Second seal 116 and/or third seal 115 may be constructed of a polymer such as, for example, silicone rubber, elastomer or poron. Second seal 116 and/or third seal 115, like first seal 112, may be any suitable shape as necessary to be received within the provided adaptation in main body surface 120A. This includes, for example cylindrical, rectangular or ellipsoid shapes. Seals 116 and/or 115 may be for example, an off the shelf component or custom molded or extruded. Seals 116 and/or 115 may also be secured to the main body by any number of means such as, for example, adhesive tape, press fitting, heat or ambient cured epoxy or adhesive, RTV, ultrasonic welding or other techniques known to one of ordinary skill in the art.

Thermal verification of the performance of tray assembly 110 can be accomplished, for example, by evaluating measured temperatures of selected vessels in an array of vessels. Additionally, the effectiveness of tray assembly 110 may be determined by comparing the results of multiple temperature experiments. One temperature experiment may use a tray assembly 110 of the present teachings. Another temperature experiment may use a tray assembly constructed of a polymer and configured without adaptor 125.

Thermal experiments were conducted using thermal sensors and an appropriate computer controlled data acquisition system like, for example, the Agilent 3490A Data logger together with the BenchLink Software for data acquisition. During the measurements, thermal sensors were placed on center wells and corner wells because, as is well known to one of ordinary skill in the art, the greatest temperature difference across a plurality of wells during cycling, due to edge effects, exists between the center and corner regions.

Figure 4:
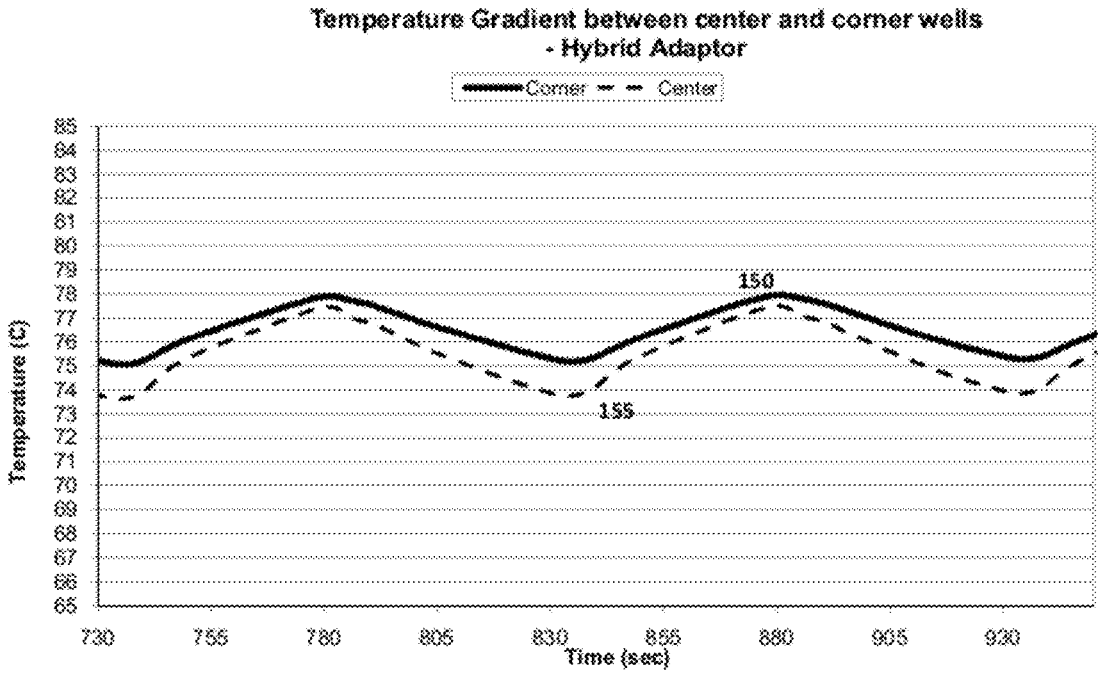
FIG. 4 is a graph depicting the temperature of a well in the center of an array of vessels, and the temperature of a well at a corner of an array of vessels in a system configuration utilizing a tray assembly constructed of a polymer.

In view of the above, FIG. 4 depicts a graph of temperature measurements from two thermal sensors, in a system incorporating a tray assembly constructed of a polymer configured without adaptor 125. The left axis represents temperature in ° C., and the bottom axis represents time in seconds. The measurements were recorded during two temperature cycles of a typical temperature protocol as discussed previously. Measurements of a first thermal sensor placed on a center well of the microtiter plate are depicted by plot 140. Measurements of a second thermal sensor placed on a corner well of the same microtiter plate are depicted by plot 145. The vertical difference between the plots represents the temperature non-uniformity across a plurality of wells of the microtiter plate. Based on the data gathered through these two temperature cycles, the temperature difference between the center well and the corner well was about 3.56° C.

Figure 5:
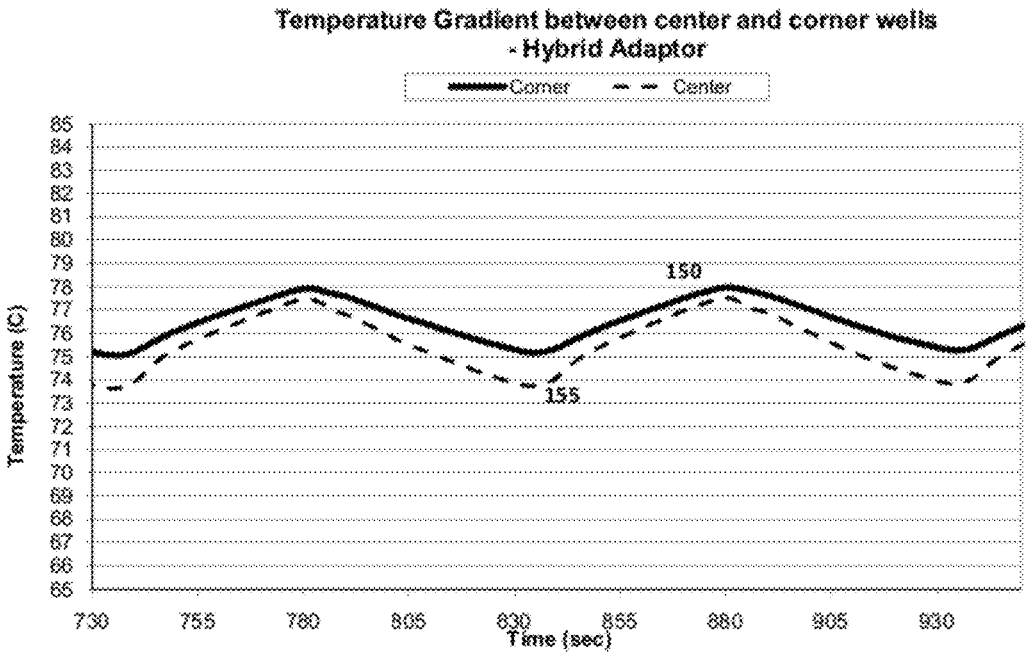
FIG. 5 is a graph depicting the temperature of a well in the center of an array of vessels, and the temperature of a well at a corner of an array of vessels in a system configuration utilizing a tray assembly according the present teachings.

FIG. 5 also depicts a graph of temperature measurements from two thermal sensors, albeit in a system incorporating a tray assembly having thermal characteristics of the tray assembly of the current invention, such as the tray assembly of FIG. 3, having the main body and adaptor 125. The left axis represents temperature in ° C., and the bottom axis represents time in seconds. It is important to recognize the scale on the left of the graph and the scale at the bottom of the graph represent the same ranges of temperature and time as the corresponding axes depicted in FIG. 4. The measurements were recorded during two temperature cycles, during the same time period of a typical temperature protocol as presented for FIG. 4. Measurements of a first thermal sensor placed on a center well of the microtiter plate are depicted by plot 155. Measurements of a second thermal sensor placed on a corner well of the same microtiter plate are depicted by plot 150. Again, the vertical difference between the plots represents the temperature non-uniformity across the plurality of wells of the microtiter plate. Based on the data gathered through these two temperature cycles, the temperature difference between the center well and the corner well, was on the order of 1.45° C. As compared to the data presented in FIG. 4 above, this represents about a 60% improvement in temperature non-uniformity by incorporating the tray assembly of the present teachings.

Also known in the art of bio-analysis is the use of Ct, or threshold cycle, and the standard deviation of the Ct of all the wells in the array of vessels in analyzing the results of nucleotide processing on a biological sample. Threshold cycle analysis is well known to one of ordinary skill in the microbiology arts as discussed, for example, in U.S. Pat. No. 7,228,237 entitled "Automatic Threshold Setting and Baseline Determination for Real-Time PCR", issued Jun. 5, 2007, which is hereby incorporated by reference in its entirety. Three dimensional graphs of Cts and the standard deviation of Cts across a plurality of vessels after nucleotide processing, can be used to gain insight into the degree of thermal non-uniformity of the thermal cycler system. As known in the art of bio-analysis, the more consistent the Ct values are across the microtiter plate, and the lower the standard deviation, the lower the thermal non-uniformity of the thermal cycler system might be.

Figure 6:
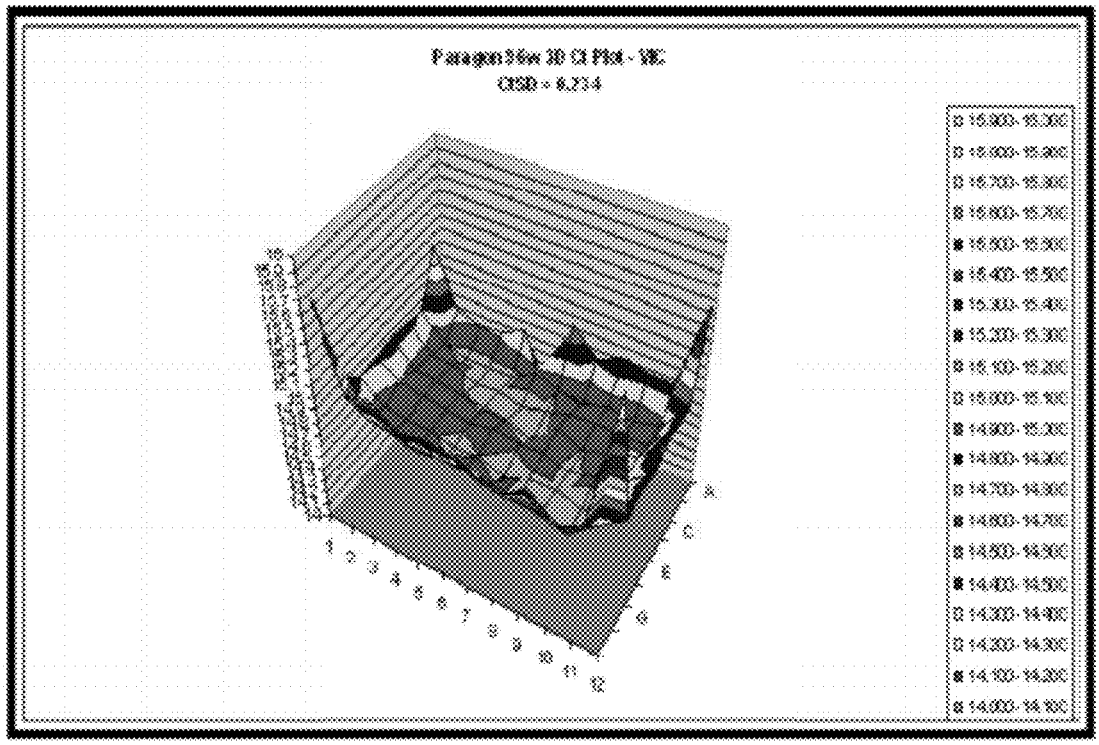
FIG. 6 is a three dimensional graph depicting the resulting Ct values across a microtiter plate with the use of a tray assembly constructed of a polymer.

In view of the above, additional verification of the present teachings was also conducted utilizing a Ct and standard deviation of Cts analysis of nucleotide processing. Two such graphs and data points are presented here. The data presented in the graphs represent the results of dual-reporter gene expression experiments. Such experiments are well known in the art of bio-analysis. FIG. 6 represents the Ct values extracted from appropriate analysis software. The left axis represents Ct values, the bottom axis adjacent to the Ct axis represents the rows of wells across a microtiter plate and the third axis represents the columns of wells across a microtiter plate. The data presented in FIG. 6, was collected from a system incorporating a tray assembly constructed of a polymer, without adaptor 125. The graph shown in FIG. 6 depicts results of the dual-reporter experiment that shows the corner wells and edge wells have a higher Ct value than the rest of the wells. Additionally the standard deviation of the Cts is shown to be 0.234.

Figure 7:
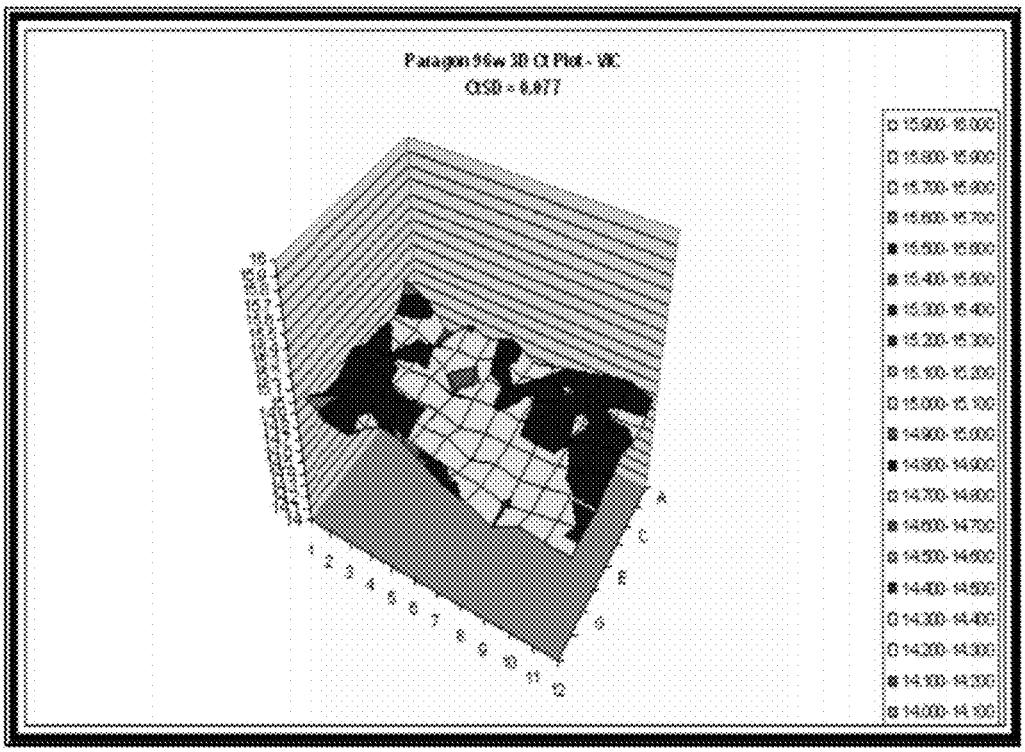
FIG. 7 is a three dimensional graph depicting the resulting Ct values across a microtiter plate with the use of a tray assembly according to various embodiments of the present teachings.

FIG. 7 also represents the Ct values and Ct standard deviation extracted from analysis software as presented above. The data presented in FIG. 7 was collected from a system incorporating a tray assembly of the present teachings, constructed of the main body and adaptor 125 both depicted in FIG. 3, and described previously. Once again, the left axis represents Ct values, the bottom axis adjacent to the Ct axis represents the rows of wells across a microtiter plate and the third axis represents the columns of wells across a microtiter plate. It is important to recognize the Ct scale on the left of the graph and the two scales at the bottom of the graph represent the same ranges of Ct, rows and columns of the corresponding axes of FIG. 6. A visual comparison can be made between the data presented in the graph of FIG. 6 to the data presented in the graph of FIG. 7. It should be obvious to one skilled in the art, that the reduction of Ct values of the corner wells and edges of FIG. 7 represents a noted improvement in Ct uniformity during the dual-reporter gene expression analyses, as compared to FIG. 6. Moreover, as compared to the Ct data presented in FIG. 6 above, the Ct standard deviation across the array of vessels is 0.077, or about a 67% improvement in standard deviation, directly related to the use of the tray assembly of the present teachings.

The following descriptions of various implementations of the present teachings have been presented for purposes of illustration and description. It is not exhaustive and does not limit the present teachings to the precise form disclosed. Modifications and variations are possible on light of the above teachings or may be acquired from practicing of the present teachings. Additionally, the described implementation includes software but the present teachings may be implemented as a combination of hardware and software or in hardware alone. The present teachings may be implemented with both object-oriented and non-object-oriented programming systems.

What is claimed is:

1. A thermal cycler comprising a tray assembly, comprising a main body made of at least a first material having a first thermal conductivity and comprising a main top surface and an opposing main bottom surface and a plurality of main apertures extending through the main body from the main top surface to the main bottom surface; and an adapter made of a second material having a thermal conductivity that is greater than the thermal conductivity of the first material and comprising an adapter top surface and an opposing adapter bottom surface, and a plurality of adapter apertures extending through the adapter from the adapter top surface to the adapter bottom surface, and a seal, coupled to the adaptor, encircling the plurality of adapter apertures, wherein the adapter top surface is configured to be secured to the main bottom surface such that each main aperture is aligned with one adapter aperture thereby configuring the tray assembly to receive one or more sample vessels; and wherein the main body further comprises an adaptation being shaped to receive the seal;

a control block configured to control the temperature of one or more nucleotide samples contained in the one or more sample vessels;

a thermal cover sized and positioned above the tray assembly to at least partially cover the one or more sample vessels; and a sample block positioned below the tray assembly including one or more depressions configured to receive the one or more sample vessels containing the one or more nucleotide samples.

2. The thermal cycler of claim 1, wherein the adapter is disposed between the main body and the one or more nucleotide samples.

3. The thermal cycler of claim 1, wherein the tray assembly is located between the thermal cover and the sample block and configured to produce a predetermined temperature uniformity of the vessels located within the sample block during operation of the thermal cycler.

4. The thermal cycler of claim 3, wherein the adapter material is a metal and selected to provide a temperature uniformity of less than or equal to 0.6 degrees Celsius.

5. The thermal cycler of claim 3, wherein the adapter material is a metal and selected to provide a temperature uniformity of less than or equal to 0.5 degrees Celsius.

6. The thermal cycler of claim 3, wherein the adapter material is a metal and selected to provide a temperature uniformity of less than or equal to 0.3 degrees Celsius.

7. The thermal cycler of claim 3, wherein the adapter is further configured to be secured to the main top surface.

8. The thermal cycler of claim 7, wherein the seal is selected from a group consisting of a top seal disposed between the main body and a thermal cover, one or more bottom seals disposed between the main body and a sample block, and a combination thereof.

9. The thermal cycler of claim 3, wherein the main body is made of a polymer material and the adapter is made of a metal material.

10. The thermal cycler of claim 9, wherein the polymer material comprises polycarbonate and the metal material comprises a metal selected from the group consisting of aluminum, copper, and steel alloy.

11. The thermal cycler of claim 1, wherein the seal is composed of a polymer material.

12. The thermal cycler of claim 3, wherein the adapter material has a thermal conductivity greater than 200 W/(m*K).

* * * * *